US005215622A

United States Patent [19]

Schmelzer

[11] Patent Number: 5,215,622

[45] Date of Patent: Jun. 1, 1993

[54] LABELING MACHINE FOR BOTTLES OR THE LIKE

[75] Inventor: Stephan Schmelzer, Neutraubling, Fed. Rep. of Germany

[73] Assignee: Krones AG Hermann Kronseder Maschinenfabrik, Neutraubling, Fed. Rep. of Germany

[21] Appl. No.: 844,900

[22] Filed: Mar. 2, 1992

Related U.S. Application Data

[63] Continuation of Ser. No. 683,879, Apr. 11, 1991.

[30] Foreign Application Priority Data

Apr. 18, 1990 [DE] Fed. Rep. of Germany ..... 4012331

[51] Int. Cl.[5] ..... B65C 9/00

[52] U.S. Cl. ..... 156/566; 156/378; 156/567; 156/570; 118/314; 118/319; 118/320; 118/321; 427/424

[58] Field of Search ..... 156/278, 566, 567, 570, 156/571, 573; 118/300, 301, 305, 313, 314, 315, 318, 319, 320, 321; 427/389.7, 407.2, 420, 424, 425

[56] References Cited

U.S. PATENT DOCUMENTS

| | | | |
|---|---|---|---|
| 2,415,512 | 2/1947 | Malloy | 118/313 X |
| 4,721,544 | 1/1988 | Zodrow et al. | 156/456 |
| 4,985,286 | 1/1991 | Kurita et al. | 427/389.7 X |

FOREIGN PATENT DOCUMENTS 2047578 12/1980 United Kingdom .

OTHER PUBLICATIONS

Facelift for Returnable Bottles, Apr. 26, 1984.

*Primary Examiner*—David A. Simmons
*Assistant Examiner*—James J. Engel, Jr.
*Attorney, Agent, or Firm*—Ryan, Kees & Hohenfeldt

[57] ABSTRACT

The invention is used in a labeling machine for applying liquid to the surface of the bottles after the labels are applied for the purpose of rendering scratches, abrasions, chipping and chafing of the bottle surfaces invisible. To minimize the space taken by the combination of the labeling machine and the new liquid applicator device, the device is associated with the outfeed starwheel of the labeling machine. The liquid applicator device includes a fixed arcuate friction and applicator surface on which the bottles roll by reason of being orbited in the outfeed starwheel and, while rolling, the bottles receive their coating of liquid from the applicator surface. The applicator surface is spongy and maintains a coating of the liquid on it which is applied to the surface by means of spray nozzles which are timed to spray the applicator surface by projecting a fanshaped spray through the space between successive bottles as the bottles are moving orbitally by the rotating outfeed starwheel.

31 Claims, 2 Drawing Sheets

4
27
28
2
28
21
42
41
3
40
43
27
9
26
1
12
26
11
26
10
18
33
48
31
9
24
14
19
20
7
16
13
8
23
6
22
5
25
2

LABELING MACHINE FOR BOTTLES OR THE LIKE

This is a continuation of copending application Ser. No. 07/683,879 filed on Apr. 11, 1991.

BACKGROUND OF THE INVENTION

The invention disclosed herein relates generally to a bottle labeling machine and, in particular, to apparatus for applying a blemish concealing curable liquid coating to the bottles.

Reusable glass or plastic bottles often become unsightly as a result of nicking, scratching, chipping and abrading during repeated recycling in bottling plants as well as in transport to and from the user. Most of the scratches and so forth on the bottles occur in the upper and lower zones of the cylindrical bottle bodies. To make the bottles more attractive, some bottling plants apply a thin film of liquid plastic such as siloxane which covers the scratched and abraded zones and imparts a new appearance to the bottles. German patent specification DE-OS 29 41 105 shows and describes a film application system.

It has been proposed to moisten reusable bottles in the bottling plant with a cold liquid treating agent such as is applied to the bottles in the glassworks. In the bottling plant, the protective film applied by the glass bottle manufacturer is thereby renewed. It is also a known practice to apply a colored film to bottles in the form of a liquid, viscous or pasty plastic substance as a protective coating. In the ensuing description, any liquid, viscous or pasty agent suitable for application to the surface of bottles are encompassed in the word "liquid" in the interest of brevity.

There are in use in industry specialized free-standing machines which are dedicated to applying curable liquid coatings to bottles. The bottles undergoing treatment are transported in a circular path by means of a conventional starwheel and while being translated, are set in rotation by rolling on a curved surface which has frictional properties in conjunction with rolls which turn with the transport starwheel or slide shoes of elastic material which are moistened continuously with the liquid being applied to the bottles. Generally, these specialized machines apply the coating liquid to the bottles before they are labeled which is satisfactory insofar as the application of the liquid is concerned. However, use of these specialized machines is disadvantageous because the machines must necessarily occupy a large amount of space and they are expensive investments.

Some known labeling machines more desirably have a liquid coating application arrangement associated with a turntable and the bottles are acted upon before arriving at the labeling station. An example is given in German patent specification DE-OS 30 08 096. The applicator arrangement in this case is fully integrated into the labeling machine so that no additional space is required in the bottling plant for a specialized machine and the additional investment costs are more moderate. These machines have fewer problems in connection with transporting bottles since, for feeding the bottles into the machine with uniform spacing between them, an infeed worm conveyor is present already and the bottles can be accurately and gently transported by the transport starwheels. The starwheels are conventionally comprised of vertically spaced apart generally circular jointly rotating plates which have pockets equally spaced around their circumference for receiving bottles. Almost invariably, they are associated with centering bells which are lowered to engage the mouth end of the bottles to stabilize them as they are transported on a turntable and which can be raised to release the bottles for discharge at high production rates. Unfavorable characteristics of the known machines is that they can foul up the labeling station and they to some degree impair adhesion of the label as a result of the liquid coating being applied to the bottle shortly before the label is applied. Moreover, a large part of the treatment path on the turntable is used for labeling so that only simple labeling runs can be made or an unusually large and correspondingly expensive labeling machine must be used.

SUMMARY OF THE INVENTION

A basic objective of the present invention is to accomplish applying a liquid coating to bottles in a labeling machine without interfering with the labeling process itself and to preserve the capability of the labeling machine to apply a variety of labels to the neck and front and back of the body of the bottles while at the same time, enhancing the appearance of the labels on the bottle by reason of the clear brightening coating being applied to them.

According to the invention, the entire turn-table structure and the infeed starwheel are available for labeling, aligning and translating bottles. Thus, there is no restriction with respect to a dedicated labeling machine without a liquid applicator device. Since in the new arrangement, the liquid is applied only after the label or labels are applied, the labeling process can be carried out without regard to the liquid coating process. The new arrangement provides for problem and interference free application of the liquid since the bottles are transported in the outfeed starwheel of a labeling machine with uniform spacing, and enclosed linkage and with virtually all sides of the bottles being accessible. Mounting of suitable liquid applicator devices, therefore, is not problematical.

The new arrangement makes available a long liquid treatment path extending along as much as 270° of the outfeed starwheel.

Another feature of the new labeling and liquid applicator machine is that the bottles are set in rotation in the outfeed starwheel so that it is possible to have an especially simple applicator device construction and an especially uniform application of the liquid. It also allows for triple and even quadruple rotation of the bottles in the outfeed star which suffices for application of virtually all liquids one would want to apply to bottles.

According to the invention, the liquid is sprayed onto a curved friction surface concentric to the outfeed starwheel and the liquid is transferred to the bottles as they roll along this surface. Consumption of the coating liquid is kept low by this kind of application device. In one arrangement, there are double duty upper and lower friction and liquid holding surfaces which have a space between the surfaces and can provide for limiting application of the coating liquid to the upper and lower extremities of the cylindrical part of the bottles. The nozzles which spray the liquid onto the curved friction and liquid transfer or applicator surfaces orbit with the outfeed starwheel so it becomes possible to spray the liquid onto the spongy friction surface without spraying directly on the bottle which might result in an uneven surface and in liquid runs on the bottle.

How the foregoing features and objectives of the invention and other objectives of the invention are achieved will be evident in the ensuing more detailed description of a preferred embodiment of the invention which will now be set forth in reference to the drawings.

DESCRIPTION OF A PREFERRED EMBODIMENT

Figure 1:
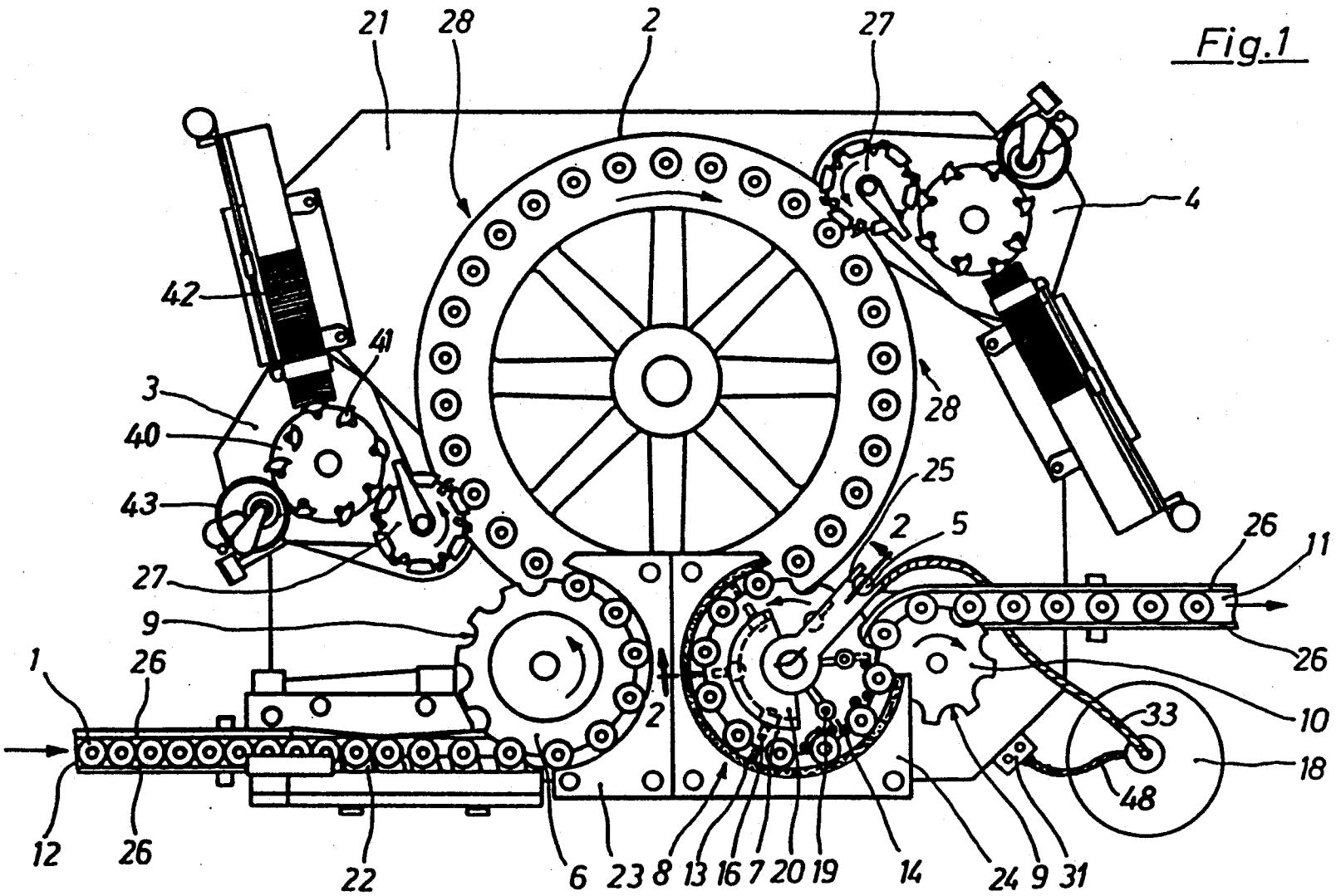
FIG. 1 is a plan view of a machine for applying a plurality of labels to a bottle and subsequently applying a self curing liquid coating to the bottles.
Figure 2:
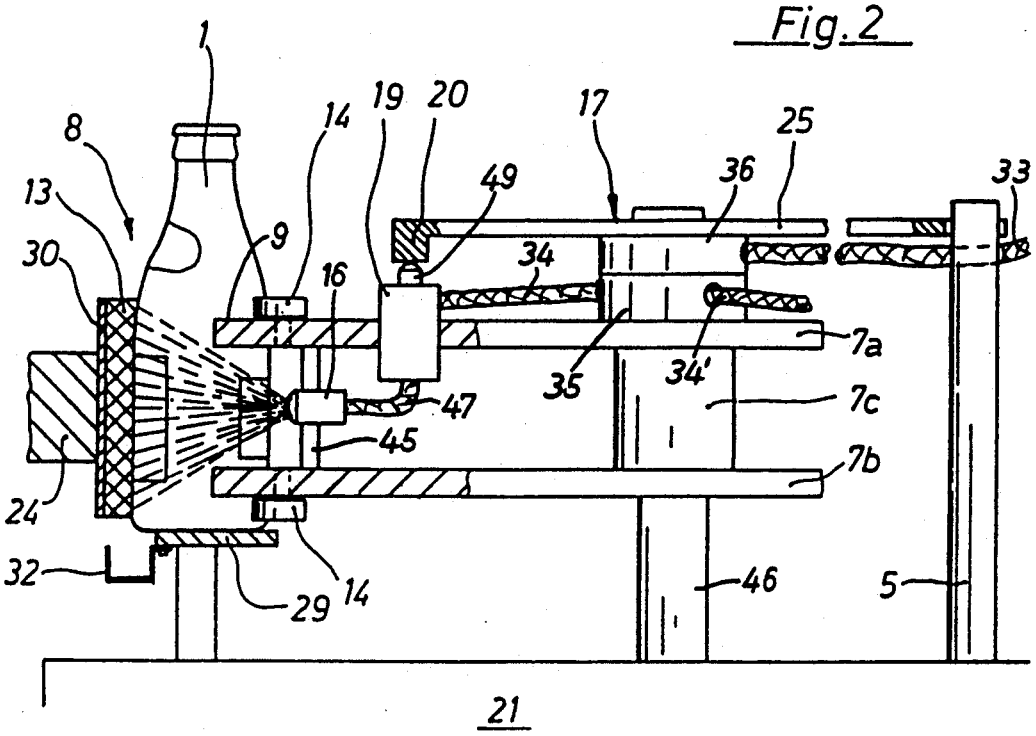
FIG. 2 is a vertical section taken on the irregular line 2—2 in FIG. 1.

The machine depicted in FIGS. 1 and 2 is arranged for applying labels to upright reusable glass bottles 1 and subsequently applying an instantly curing liquid plastic to areas of the bottles which are no longer shiny because of having blemishes. The machine comprises a housing 21 which contains a motor and driving mechanism, neither of which is shown. On housing 21 there is a turntable 2 which turns about a vertical axis. At the left of FIG. 1, bottles are supplied to the machine by way of a conveyor belt 12 which has a pair of side wall guides 26 for directing the bottles into a helically grooved infeed conveyor screw 22. The continuously rotating conveyor screw 22 presents bottles successively into the pockets 9 of an infeed starwheel 6 which rotates next to turntable 2 about a vertical axis. The pockets 9 on infeed starwheel 6 are equiangularly spaced apart around the periphery of the starwheel for presenting bottles to the rotary table 22 at regular and uniform intervals. The models are supported in an upright position on turntable 2 by conventional means which are not shown and the bottles are rotated as they are carried around the turntable 2 as indicated by the arrow on the turntable.

Immediately after the bottles are transferred from the infeed starwheel 6 to the turntable 2, the bottles encounter a first labeling device which is generally designated by the numeral 3. The labeling device has a turret wheel 40 rotating about a vertical axis. A plurality of oscillating pallets 41 are carried on the wheel. The oscillating curved surfaces of the pallets acquire a coating of glue when they pass a glue roller 43 and the pallets use the glue to pick up a label from a label magazine 42 as they pass the magazine. The labels are then carried on the pallets to a transfer wheel 27 which deposits the glued side of the label on the bottles 1 which are rotating by conventional means, not shown. The bottles are then carried on turntable 2 to a second labeling station which is like the first one and is generally designated by the reference numeral 4. Since the two labeling devices are similar, the second one need not be described. In actual machines there are brushes or a sponge roll, not shown, about where the arrowheads of the lead lines from the numerals 28 occur, for pressing the labels securely to the rotating bottles.

After the second labeling device acts on the bottles, they are carried along the turntable 2 until they meet an outfeed starwheel 7. The outfeed starwheel also has pockets in its periphery into which the bottles are inserted from turntable 2. A circular support plate 30 is arranged concentrically to the outfeed starwheel 7 as is evident in FIG. 2 most permanently and as is evident in FIG. 1, there is a layer of porous spongy material 13 applied to the inside of the curved support plate 30 which is fixedly mounted on an element 24. The surface of the spongy material 13 has the coating liquid sprayed onto it as will be explained as the bottles receive the coating liquid as they roll along the curved spongy surface. The bottles, after being treated with liquid while they are being transported by the first outfeed starwheel 7, are then transferred to the pockets 9 of the second outfeed starwheel 10. The labeled and coated bottles are then discharged by the second starwheel 10 to an output conveyor belt 11 which has side guides 26 for keeping the bottles in line as they are rapidly being transported by the conveyor belt 11. As will be evident in FIG. 2, particularly, the bottles are supported on transfer plates 29 as they progress with the starwheels 6, 7 and 10. The bottle conveying devices 2, 6, 7, 10 and 22 and the conveyor belts 11 and 12 are driven in synchronism with each other by conventional means, not shown, so the bottles can be transported gently in accurate positions even at very high production rates.

At the first labeling station 3, the bottles have a body label and a breast label applied. At the second labeling station 4, the bottles have a back label applied and the ensuing brush or sponge rolls at position 28 press the labels on the rotating bottles. The fully labeled bottles then run into the pockets of the first outfeed starwheel 7.

As can be seen most readily in FIG. 2, the first outfeed starwheel 7 comprises a circular upper plate **7*a* superimposed over a similar lower plate 7*b*. The plates 7*a* and 7*b* are fixed in parallel spaced relationship with each other on a common hub 7*c*. The upper and lower starwheel plates 7*a* and 7*b* have pockets 9 in their peripheries for accepting bottles 1. On the upper side of the upper plate 7*a* and on the underside of the lower plate 7*b*, pairs of freely turnable guide rollers 14 are arranged adjacent each pocket 9. The axes of the rollers are parallel to the axis of rotation of the outfeed starwheel 7. The rollers 14 engage the cylindrical part of the bottle body in its uppermost and lowermost zones and thus make possible transportation of the bottles in the first outfeed starwheel at exact positions and the rollers contribute to uninhibited rotation of the bottles 1 in the first outfeed starwheel 7**.

As was alluded to briefly earlier, there is a device 8 used for applying the liquid to the fully labeled bottles 1 as they are moved in pockets 9 on an arcuate path by means of outfeed starwheel 7. Device is comprised of the dual purpose friction driving and liquid application element 13 which is arranged concentrically to the outfeed starwheel 7. The curved friction-applicator element 13 and its curved support plate 30 extend at least over 180° of the starwheel and preferably up to about 270°, in accordance with the invention, to allow for an opening through which the bottles 1 can be discharged from the first outfeed starwheel pockets to the pockets of the second outfeed starwheel 10 which puts the bottles on the outfeed conveyor belt 11. In an actual embodiment, the friction drive and liquid applicator element 13 consists of a closed-pore Neoprene foam which is cemented to the circular supporting plate 30. As is evident in FIG. 2, the support plate 30 is fastened to a fixed member 24. The parts of device 8 are so arranged that the bottles present in the pockets 9 of the first outfeed starwheel 7 are pressed into the resilient foam element 13 and, therefore, the bottles come under the frictional influence of element 13. Because the bottles are moving orbitally under the influence of the first outfeed starwheel 7 and are pressed into the frictional surface of the porous resilient applicator element 13, the bottles are compelled to rotate continuously while rolling on the face of element 13.

In the FIG. 1 embodiment, the outfeed starwheel 7 has the same diameter as the infeed starwheel 6. These starwheels have relatively large diameters. The resulting relatively large circumference of the outfeed starwheel 7, in particular, provides for a long circular path along which the bottles are continuously rotated for 270° of the path. The arrangement allows for at least a quadruple rotation of the bottles which is even maximized by the second outfeed starwheel 10 rotating in a direction opposite of the first outfeed starwheel 7. This also shortens the path through which the bottles 1 must be carried in the second starwheel before they are discharged to a conveyor belt 11.

Figure 3:
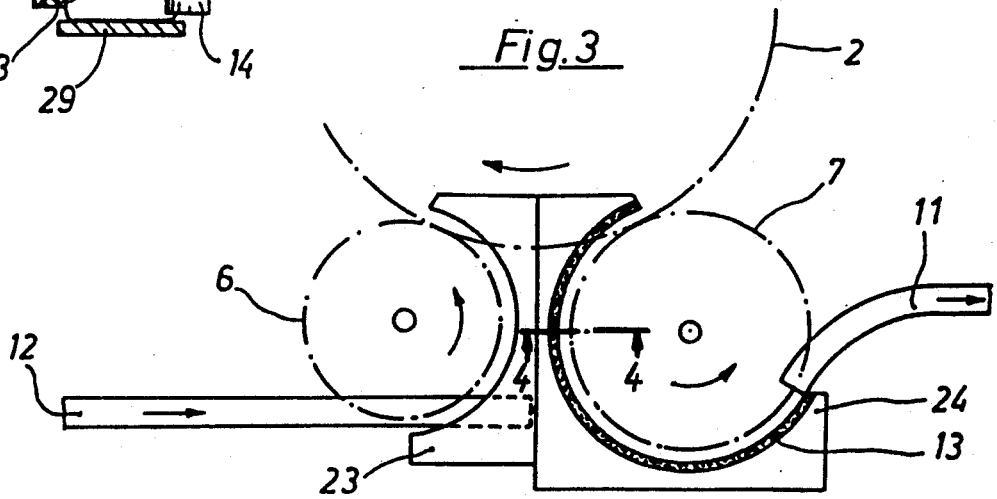
FIG. 3 is a diagrammatic view of an alternative embodiment of the invention.

FIG. 3 is a diagram of an alternative arrangement of the invention wherein the outfeed starwheel 7 has a larger diameter than the infeed starwheel 6. The second outfeed starwheel 10 of the FIGS. 1 and 2 embodiment has been eliminated. In the FIG. 3 arrangement, the outfeed conveyor belt 11 runs tangentially to the outfeed starwheel 7 and, therefore, the outfeed conveyor belt 11 is at an acute angle in respect to the infeed conveyor belt 12. With this arrangement, the desirable feature of having a long friction drive applicator 13 surface is preserved.

The manner in which the bottle coating liquid is sprayed onto the friction-applicator element 13 for transfer therefrom to the bottle as the bottle rolls on the surface of the element 13 will now be described in greater detail in reference to FIG. 2 primarily. The liquid is stored in a tank 18 shown in FIG. 1 and is conducted to a plurality of nozzles such as the one marked 16 in FIG. 2. The nozzle's orifice is a vertical slit which accounts for the fanshaped beam of liquid which is represented by the fanshaped collection of dashed lines in FIG. 2. In FIG. 1, it is possible to see that in this particular embodiment three spray nozzles 16 are used and that they are arranged angularly from each other to spray liquid onto the spongy foam element 13 concurrently through a path between any pair of bottles so that the liquid is never sprayed directly onto the bottles.

Considering FIG. 2 again, the nozzles 16 are mounted to bracket members 45 extending between upper and lower plates *7a* and *7b* which comprise the first outfeed starwheel 7. All of the spray nozzles 16, therefore, orbit together with the first outfeed starwheel 7 and they are turned on to spray for a moment when the spaces between bottles are aligned with the nozzles. FIG. 1 shows the nozzles angularly spaced apart to coincide with every other or alternate space between bottles. In some arrangements, it may be desirable to have a nozzle for each space between two consecutive bottles. Generally, more nozzles will be used where higher consumption of liquid is tolerable or a thicker coating of the liquid is needed in which case it is desirable to have a generous amount of liquid on the surface of the friction-applicator element 13. On the other hand, when a lower liquid consumption or a lesser liquid coating thickness is acceptable, only one spray nozzle might be used or there might be only one for every third or fourth space between consecutive bottles in the pockets 9 of the first outfeed starwheel 7.

In the FIG. 2 embodiment, it will be evident that the fan-shaped spray from nozzle 16 lands substantially entirely over the entire height and over essentially all of the length of the element 13. In the actual embodiment, the spray jet ends at a slight distance from the upper and lower edges of the friction-applicator 13 surface so the spray jet is prevented from going beyond the element 13. Note that the plane of the fan-shaped jet lies on a plane which passes through the center of rotation of the outfeed starwheel 7.

Referring to FIG. 2, outfeed starwheel 7 is fixed to a driven shaft 46 which rotates the starwheel. A hub *7c* is keyed to shaft 46 and upper and lower plates *7a* and *7b* which comprise the outfeed starwheel 7 are fastened to hub *7c*. A cylindrical distributor member 35 is mounted to the top plate *7a* of the first outfeed starwheel 7. Distributor member 35 rotates coaxial with the starwheel 7 and has liquid fed into it from a stationary cylindrical member 37 which interfaces with cylindrical member 35 in a leak proof fashion. Hose 33 runs from the storage tank 18 in FIG. 1 to the stationary cylindrical member 36 in FIG. 2 to keep liquid pressure applied to the inlet of a fast acting valve 19 through a short radially extending hose section 34. Each nozzle 16 has its own valve 19. The outlets of the valves 19 are connected to the inlets of the spray nozzles 16 by means of short hoses 47. The liquid in storage tank 18 is pressurized under the influence of compressed air which, as shown in FIG. 1, is delivered to tank 18 by way of a hose 48 which leads from an air pressure regulator 31. The source of compressed air is not shown. The stationary cylindrical member 36 of liquid distributor 17 is fastened to a stationary horizontal arm 25 which is mounted to a column 5 that is fixed on the top of machine housing 21. There may be an arm 25 provided for each of the fast acting valve 19 and spray nozzle 16 combinations. The arms 25 support circumferentially extending cam surfaces 20. As the fast acting valves 19 and their associated spray nozzles 16 arrive at angular positions corresponding with spaces between bottles being carried in outfeed starwheel 7, the operating pins 49 of the valves 19 slide onto the control cam 20 surface which depresses the pins 49 and opens the valves 19 for an instant during which the fan-shaped jet of liquid is sprayed from nozzles 16. Of course, if there are a plurality of nozzles, there will be pressurized liquid supplied, not only through hoses 34 to the illustrated quick through hoses such as the one marked 34' on the rotatable distributor member 35 in FIG. 2. Note in FIG. 1 that the control cam 20 begins shortly after the beginning of the friction-applicator element 13 and ends at about ⅔ of its length. When the valves 19 orbit past the control cam 19, the valves are able to close automatically under the influence of internal operating springs, not shown. This assures that there will be no spraying from the nozzles 16 when they have orbited past the trailing end of the friction-applicator element 13 adjacent the second outfeed starwheel 10.

Figure 4:
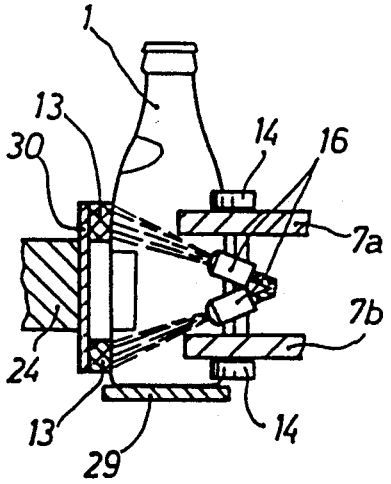
FIG. 4 is a vertical section taken on the line 4—4 in FIG. 3.

In the FIG. 2 embodiment, as has been explained, the surface of the spongy applicator 13 is covered over its height with liquid sprayed from the nozzle 16. In the FIG. 2 arrangement, most of the height of the cylindrical body of the bottle has the coating liquid applied to it and to the labels thereon. There is another arrangement in FIG. 4 adapted for limiting application of the coating liquid to those upper and lower regions of the bottle body which are most likely to need treatment with the liquid to obscure their blemishes. In FIG. 4, the applicator surface 13 is divided into two portions and there is a space between them which will avoid application of the coating liquid to the label if that is desired. Moreover, there can be some saving in coating liquid if the treatment area is limited to those zones on the bottle which need it most. In the FIG. 4 embodiment it is necessary to have two nozzles 16 working together but they can have their inlets connected to a common outlet from their associated quick acting valve 19. When production of labeled bottles in the machine is started, the manual or automatic opening of pressure regulating valve occurs and compressed air is supplied to tank 18 to make liquid under pressure available to the valves 19 and, hence, to the spray nozzles 16. If the labeling machine is still at a standstill when the pressure is turned on and if the operating pins 49 of the valves 19 happen to be positioned with respect to operating cams 20 at startup, only partial areas of the friction-applicator 13 surface will receive sprayed on liquid. Since there is substantially no storage in the closed-pore spongy friction element 13, the liquid runs off of the element downward and is collected in a gutter 32 which covers the entire length of the curved element 13. If the labeling machine is running already, but there are no bottles present, there might still be application of the liquid to element 13 over much of its circumferential length since the valves 19 would be operated open as they pass under the cam surfaces 20. No harm is done by this since the liquid will still drain off of the surface of element 13 for being collected in trough 32 for recycling. Therefore, it is desirable that the regulating valve 31 be opened only shortly before the first labeled bottles reach the outfeed star 7. Automation of this process can be carried out in a simple fashion since labeling machines usually have at least one bottle position sensor by which the label delivery is controlled. With automatic control, even the gutter 32 can be eliminated.

The labeled bottles entering the first outfeed starwheel 7 are received against rollers 14 adjacent the pockets and by rolling along the fixed friction applicator element 13, the bottles are caused to rotate continuously. While rotating along the surface of element 13, the bottles receive a uniform coating of the liquid applied by the spray nozzles 16 between the turning bottles. In the exit zone of the friction-applicator 13 where the bottles arrive successively, there occurs a repeated intensive rolling of the bottles and possibly squeezing out excess liquid. Layers of a few microns in thickness or a few milligrams of liquid in total can be achieved easily. The machine can be adapted for most bottle coating processes due to the flexibility that attends varying the pressure on the liquid supply container 18 and selecting different numbers and forms of spray nozzles as well as by selection of different friction-applicator element configurations.

There is also an intensive rolling on of the body and back labels which are wetted with liquid plastic or the like and this leads to an extremely nice appearing bottle.

Although a preferred embodiment of the invention has been described in considerable detail, such description is intended to be illustrative rather than limiting, for the invention may be variously embodied and is to be limited only by interpretation of the claims which follow.

I claim:

1. A machine for applying labels and a coating liquid to bottles, comprising:

a rotationally driven turntable for transporting bottles in a circular course, a rotationally driven infeed starwheel arranged adjacent the turntable for transferring bottles onto the turntable, a first rotational driven outfeed starwheel having circumferentially spaced apart pockets, said outfeed starwheel arranged adjacent the turntable and spaced from the infeed starwheel in the direction of rotation of the turntable for receiving in the outfeed starwheel pockets bottles transferred successively from the turntable, at least one bottle labeler arranged along said circular course for applying a label to the bottles before the bottles are transferred to the pockets of the outfeed starwheel, an element having an inside arcuate surface arranged concentrically to the periphery of said outfeed starwheel for bottles being transported in the pockets of the starwheel to contact said arcuate surface for frictionally imparting rotational force to the bottles, means on said outfeed starwheel adjacent each pocket therein for guiding a bottle to rotate in the pocket, and means for applying liquid to said arcuate surface for said bottles to acquire a coating of said liquid while being transported by said outfeed starwheel and concurrently rolling on said arcuate surface.

2. The machine according to claim 1 wherein said bottles are transported on said outfeed starwheel through a rotational angle of more than 180° up to about 270° between where a bottle is received in a pocket of the outfeed starwheel and where the bottle is discharged from said pocket of the outfeed starwheel.

3. The machine according to claim 1 wherein the outfeed starwheel has a larger diameter than the infeed starwheel.

4. The machine according to claim 1 including:

an outfeed conveyor and a second rotationally driven outfeed starwheel arranged adjacent said first outfeed starwheel for transferring bottles discharged form the first outfeed starwheel to said outfeed conveyor.

5. The machine according to claim 1 including:

an outfeed conveyor having a bottle input portion arranged generally tangentially to said outfeed starwheel at a place where said bottles have been transported on said outfeed conveyor at least 180° from where the bottles are received from said turntable by said outfeed starwheel.

6. The machine according to claim 1 wherein said means for applying liquid to said arcuate surface of said element comprises a spray nozzle mounted to the outfeed starwheel for being orbited therewith and said nozzle being positioned for applying liquid on said arcuate surface.

7. The machine according to claim 6 wherein said element is composed of spongy material.

8. The machine according to claim 7 wherein said spray nozzle is positioned between two circumferentially spaced apart pockets on said outfeed starwheel to provide for spraying liquid on said arcuate surface without the liquid impinging directly on the bottles in the pockets.

9. The machine according to claim 1 wherein said means for applying liquid to said arcuate surface comprise:

at least one spray nozzle mounted to said outfeed starwheel for spraying said liquid onto said arcuate surface for any part of the surface of said bottle rolling on said arcuate surface of the element to become coated with said liquid.

10. The machine according to claim 9 including:

a plurality of said spray nozzles each mounted to said outfeed starwheel in positions for directing a spray of liquid onto said arcuate surface of the element radially outwardly of said starwheel in a path between bottles, respectively, in two circumferentially spaced apart pockets.

11. The machine according to any one of claims 9 or 10 wherein the orifices of said nozzles are slits extending parallel to the rotational axis of the outfeed starwheel.

12. The machine according to claim 9 wherein said outfeed starwheel comprises two parallel circular plates having circumferentially spaced apart pockets in the peripheries thereof, said plates being spaced apart axially, and said spray nozzle is mounted between said plates for spraying liquid onto said element.

13. The machine according to any one of claims 9 or 10 including:

a rotary distributor arranged coaxially with the axis of said outfeed starwheel and having inlet means for pressurized liquid and outlet means, and conduit means for connecting said outlet means to said nozzle or nozzles, respectively.

14. The machine according to claim 13 including valve means interposed in said conduit means, and means for opening and closing said valve means, said valve means being opened only when a nozzle connected thereto is orbited to a position wherein the nozzle can spray liquid on said element.

15. The machine according to claim 14 wherein said means for opening and closing said valve means includes stationary cam means arranged to be engaged by said valve means for opening the valve means when the nozzle is in position to spray liquid on said element and to be disengaged when said nozzle is not in said position.

16. The machine according to claim 1 wherein said element applies liquid to the entire cylindrical portion of each bottle.

17. The machine according to any one of claims 9 or 10 wherein the nozzles emit a fan-shaped spray passing radially outwardly of the outfeed starwheel.

18. The machine according to any one of claims 9 or 10 wherein said element is comprised of a plurality of concentric and coaxial narrow spaced apart individual arcuate surfaces for applying liquid to said bottles at places corresponding to the positions of said spaced apart surfaces.

19. The machine according to claim 18 wherein at least one spray nozzle is provided for spraying liquid onto said individual arcuate surfaces.

20. The machine according to claim 1 wherein said element consists of a closed pore spongy material.

21. A machine for coating bottles with a liquid, comprising:

a rotationally driven starwheel having a plurality of circumferentially arranged pockets in the periphery of the starwheel, apparatus for transferring bottles successively into the pockets at an infeed station for the bottles to be transported by said starwheel and discharged after having been transported in a circular path through a predetermined angle to an outfeed station, a liquid applicator element having an arcuate surface arranged concentrically to the circular path of the bottles for said bottles to frictionally engage said element as they are transported to cause said bottles to roll on said arcuate surface, and means for applying liquid to said arcuate surface for said bottles to acquire a coating of said liquid as they roll on said surface.

22. The machine according to claim 21 wherein said means for applying liquid comprises at least one spray nozzle arranged for spraying liquid onto said arcuate surface.

23. The machine according to claim 21 wherein said predetermined angle is an angle between at least 180° and about 270°.

24. The machine according to claim 21 wherein said predetermined angle is about 270°.

25. The machine according to claim 21 wherein:

said means for applying liquid to said arcuate surface comprises at least one spray nozzle, means for mounting said spray nozzle for revolving with said starwheel, and means for activating said nozzle to spray radially outwardly of said starwheel onto said arcuate surface when said nozzle is coincident with the radius of said arcuate surface.

26. The labeling machine according to claim 25 wherein said spray nozzle is mounted to said starwheel between two pockets to provide for said nozzle spraying between bottles in circumferentially adjacent pockets when said nozzle becomes directed along a radius of said arcuate surface.

27. The machine according to claim 21 wherein:

said means for applying liquid to said arcuate surface comprises a plurality of spray nozzles mounted to said starwheel in circumferentially spaced apart relationship and arranged for spraying in a direction radially outwardly of said starwheel coincident with starwheel radii extending between two consecutive pockets in the starwheel to provide for spraying said liquid on said arcuate surface without bottles in the pockets interfering with or intercepting the sprayed liquid, and means for activating said nozzles to spray radially outwardly of said starwheel onto said arcuate surface when said nozzle is rotated with said starwheel into alignment with said arcuate surface.

28. The machine according to claim 27 including:

at least one more applicator element also having an arcuate surface on which the bottles roll, the arcuate surfaces all having radii of curvature extending through the axis of rotation of said starwheel, said arcuate surfaces are spaced apart from each other along a line parallel to the rotational axis of the starwheel, an additional spray nozzle between said pockets, one of the nozzles being arranged for spraying the liquid on one of said arcuate surfaces and the other being arranged for spraying the liquid on the other of the arcuate surfaces.

29. The machine according to claim 21 wherein:

said starwheel is designated an outfeed starwheel, said apparatus for transferring bottles into said pockets of the outfeed starwheel comprises a rotationally driven turntable adapted for receiving bottles in succession at a place corresponding to a predetermined angle of rotation and for transferring said bottles to said outfeed starwheel after said bottles, respectively, have been carried by said turntable along a circular path through an angle of rotation, and labeling apparatus arranged along said circular path and operative to apply at least one label to said bottles, respectively.

30. The machine according to claim 29 including infeed means for feeding bottles in succession to said place on said turntable where bottles are received, said last named infeed means comprising a rotationally driven infeed starwheel, said outfeed starwheel having a larger diameter than said infeed starwheel.

31. The machine according to claim 27 including a rotary distributor arranged coaxially with said starwheel and having inlet means for pressurized liquid na outlet means, and conduits for connecting said outlet means to said nozzles.

* * * * *

UNITED STATES PATENT AND TRADEMARK OFFICE

CERTIFICATE OF CORRECTION

PATENT NO. : 5,215,622

DATED : June 1, 1993

INVENTOR(S) : Stephan Schmelzer

It is certified that error appears in the above-indentified patent and that said Letters Patent is hereby corrected as shown below:

Column 8, Claim 4, Line, 46 -
"form should be ---from---.

Column 9, Claim 9, Line 3 -
"comprise" should be ---comprises---.

Column 8, Claim 8, Line 1 -
"7" should be "6".

Column 12, Claim 31, Line 9 -
"na" should be ---and---.

Signed and Sealed this

Twenty-ninth Day of March, 1994

Bruce Lehman

*Attest:*

BRUCE LEHMAN

*Attesting Officer*

*Commissioner of Patents and Trademarks*